US006671476B1

(12) United States Patent
Saiki

(10) Patent No.: US 6,671,476 B1
(45) Date of Patent: Dec. 30, 2003

(54) PROCESS CARTRIDGE AND IMAGE FORMING APPARATUS

(75) Inventor: Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/368,556

(22) Filed: Feb. 20, 2003

(30) Foreign Application Priority Data

Sep. 6, 2002 (JP) ..... P2002-261912

(51) Int. Cl.[7] ..... G03G 15/00; G03G 21/16

(52) U.S. Cl. ..... 399/111; 399/118; 399/119

(58) Field of Search ..... 399/110, 111, 399/112, 113, 118, 119, 120, 220

(56) References Cited

U.S. PATENT DOCUMENTS 6,453,135 B1 * 9/2002 Sameshima et al. ..... 399/110

FOREIGN PATENT DOCUMENTS

JP 05-323694 * 12/1993

* cited by examiner

*Primary Examiner*—Hoang Ngo
(74) *Attorney, Agent, or Firm*—Morgan, Lewis & Bockius LLP

(57) ABSTRACT

A developer storage space into which developer is stored is segmented into a first developer storage portion 116*a* arranged at an upper portion of this developer storage space, and a second developer storage portion 116*b* arranged at a lower portion thereof, while sandwiching therebetween a window portion 120 which constitutes an optical scanning path. This first developer storage portion 116*a* is communicated with the second developer storage portion 116*b* via developer paths 122*a* and 122*b*, which are provided at both sides of the window portion 120. The developer derived from the first developer storage unit 116*a* is conducted to the developer paths 122*a* and 122*b* by the first stirring/transporting member 124, and then, is supplied to the second developer storage portion 116*b* through the developer paths 122*a* and 122*b*, and furthermore, is uniformly transported by the second stirring/transporting member 130 also to a central portion of a developing unit.

7 Claims, 9 Drawing Sheets

PROCESS CARTRIDGE AND IMAGE FORMING APPARATUS

BACKGROUND OF THE INVENTION

1. Field of the Invention

The present invention is related to an electrophotographic type image forming apparatus and a process cartridge used in this image forming apparatus.

2. Description of the Related Art

As a conventional image forming apparatus, such an image forming apparatus is well known in this technical field in which a process cartridge is detachably mounted on a main body of the image forming apparatus. As one of conventional process cartridges, such a process cartridge is known in which both a cleaning apparatus and a developing apparatus are relatively arranged in an upper/lower positional relationship, while sandwiching therebetween an optical scanning path.

In the image forming apparatus employing such a process cartridge, in such a mode that transferring/fixing operations are carried out while recording mediums are transported along a substantially vertical direction, the developing apparatus is arranged under the optical scanning path. As a result, in order to reduce the height of this image forming apparatus, since the developing apparatus is located on the lower side of the optical scanning path, the height of the developing apparatus is required to be decreased. Since the developing apparatus contains a developer storage unit for storing thereinto developer, the size of this developer storage unit must be reduced. However, while the developer storage capacity is maintained, it is practically difficult to make the developing apparatus compact.

SUMMARY OF THE INVENTION

An object of the present invention is to provide a process cartridge and an image forming apparatus using the process cartridge, which can be made compact, while a sufficiently large developer storage capacity is maintained.

To achieve the above-described object, a first feature of the present invention is realized by a process cartridge detachably mounted on a main body of an image forming apparatus, comprising: an image carrier; and a developing apparatus having a developer storage space, for developing a latent image formed on the image carrier to produce a visible image; in which the developer storage space is segmented into a first developer storage portion and a second developer storage portion along upper/lower directions, while sandwiching therebetween a latent image writing position of the image carrier into which the latent image is written; and also the first developer storage portion is communicated to the second developer storage portion via a developer path. Since the developer storage space is segmented into upper/lower portions while sandwiching therebetween the developer path, even when the developer storage capacity of the second developer storage portion located under the latent image writing position is reduced, the necessary amount of the developer can be replenished with the developer stored in the second developer storage portion.

In the case that, for instance, a scanning type laser exposing apparatus is employed as a means for forming a latent image, in order to secure an optical scanning path outputted from this scanning type laser exposing apparatus, a window portion which constitutes the optical scanning path is formed between the first developer storage portion and the second developer storage portion, and also, both the first developer storage portion and the second developer storage portion are separated from each other along the upper/lower direction while sandwiching therebetween this window portion. Also, developer paths may be preferably provided on the both sides of this window portion.

Preferably, the first developer storage portion is provided with a first stirring/transporting member which stirs/transports the developer from a center of the first stirring/transporting member to both sides thereof. This first stirring/transporting member may be constituted by, for example, a wire line material. Although the first stirring/transporting member may be formed in a crank shape, this first stirring/transporting member may be formed in a helical shape in such a manner that the wire line materials are wound from a center portion thereof (viewed from axial line direction) toward both edge portions thereof along different winding direction.

Preferably, the second developer storage portion is provided with a second stirring/transporting member which stirs/transports the developer from both side portions of the second stirring/transporting member to a center portion thereof. As a result, the amounts of the developer can be made equal to each other along the axial direction. It should be understood that when the developer owns good fluidity, this second stirring/transporting member need not employ a specific structure, but may be formed in, for instance, a crank shape.

Also, the present invention may cover an image forming apparatus having the process cartridge with employment of the above-explained construction.

DETAILED DESCRIPTION OF THE PREFERRED EMBODIMENTS

Referring now to drawings, embodiment modes of the present invention will be described.

Figure 1:
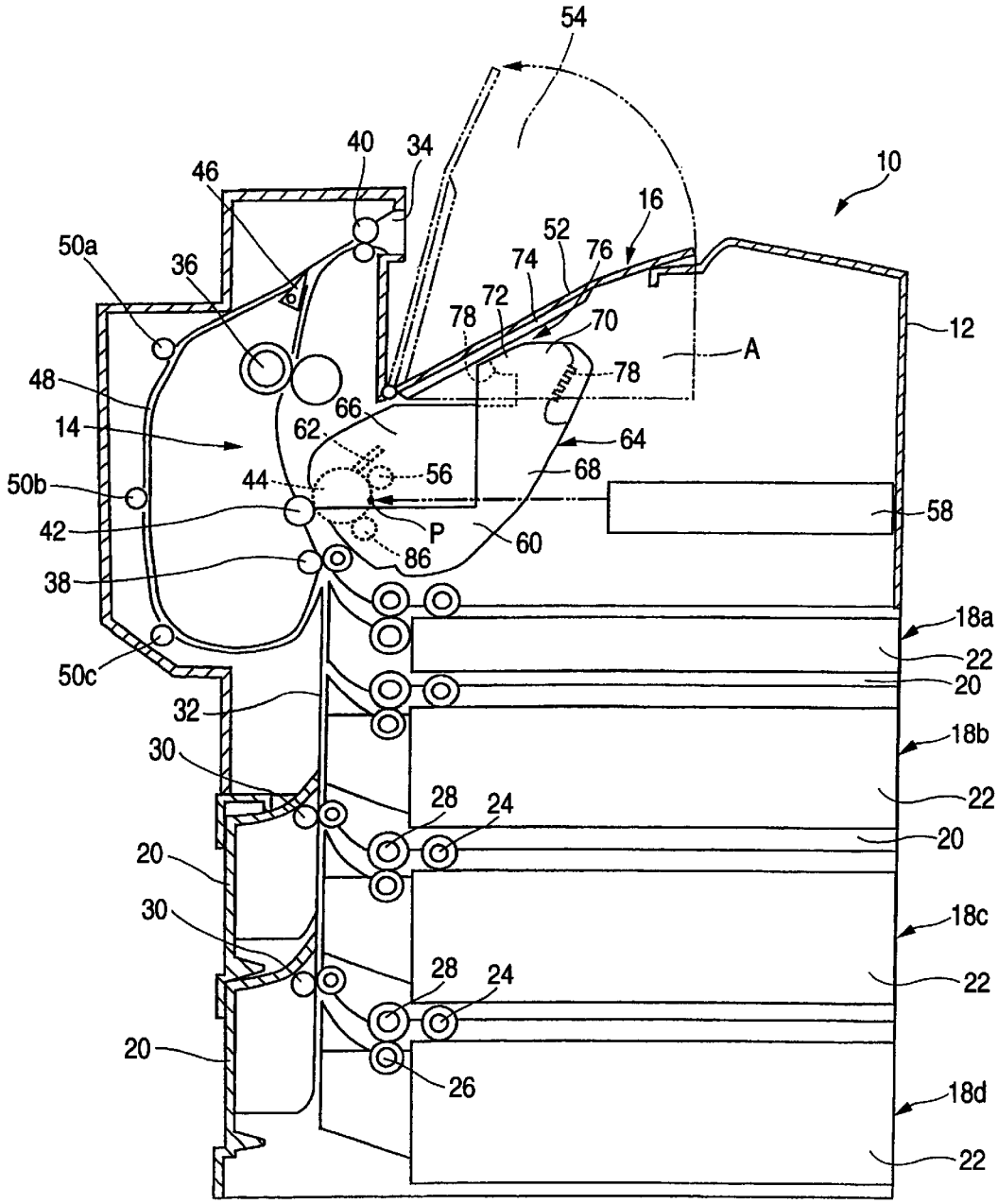
FIG. 1 is a sectional view for indicating an image forming apparatus according to an embodiment mode of the present invention.
Figure 2:
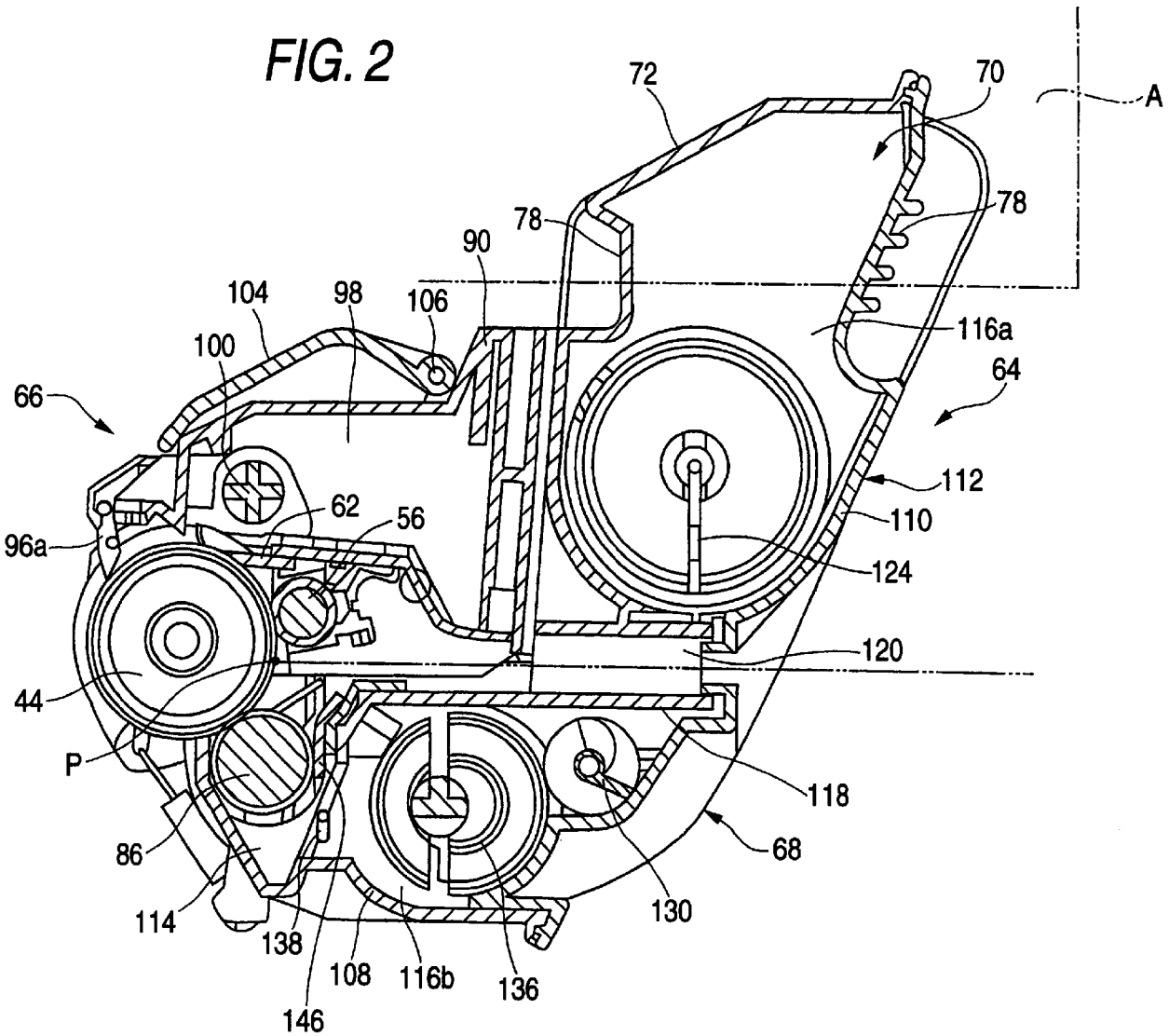
FIG. 2 is a sectional view for representing a process cartridge according to an embodiment mode of the present invention.

FIG. 1 schematically shows an image forming apparatus 10 according to an embodiment mode of the present invention. The image forming apparatus 10 contains a main body 12 of the image forming apparatus. An image forming section 14 is mounted on this image forming apparatus main body 12. An ejection unit 16 (will be explained later) is provided at an upper portion of this image forming apparatus main body 12, and also, for instance, two stages of paper supply units 18*a* and 18*b* are arranged at a lower portion of this image forming apparatus main body 12. Furthermore, two stages of paper supply units 18*c* and 18*d* are arranged below the image forming apparatus main body 12, while these paper supply units 18*c* and 18*d* are detachably mounted thereon as an optional paper supply unit.

Each of the paper supply units 18*a* to 18*d* owns a paper supply unit main body 20 and a paper supply cassette 22 into which paper is stored. The paper supply cassette 22 is slidably mounted with respect to the paper supply unit main body 20, and is drawn out from this paper supply unit main body 20 along a front plane direction (namely, right direction of FIG. 1). Also, a nudger roller 24 is arranged at an upper portion near an inner end of the paper supply cassette 22, and both a retard roller 26 and a feed roller 28 are arranged in front of this paper supply roller 24. Furthermore, feed rollers 30 are provided with the optionally-provided paper supply units 18*c* and 18*d*, and these feed rollers 30 may constitute a pair of feed rollers.

A transport path 32 corresponds to a paper path defined from the nudger roller 24 of the lowermost paper supply unit 18*d* up to an ejection port 34. While this transport path 32 is located in the vicinity of a rear surface (namely, left side surface viewed in FIG. 1) of the image forming apparatus main body 12, this transport path 32 owns such a portion which is formed along the substantially vertical direction from the feed roller 30 of the lowermost paper supply unit 18*d* up to a fixing apparatus 36 (will be discussed later). Both a transferring apparatus 42 (will be explained later) and an image carrier 44 (will be explained later) are arranged on an upper stream side of the fixing apparatus 36 of this transport path 32. Furthermore, a register roller 38 is arranged on an upper stream side of both the transferring apparatus 42 and the image carrier 44. In addition, an ejection roller 40 is arranged in the vicinity of an ejection port 34 of the transport path 32.

As a result, the recording mediums which are fed out by the nudger roller 24 from the paper supply cassettes 22 of the paper supply units 18*a* to 18*d* are smoothly separated by the retard roller 26 and the feed roller 28 to be conducted to the transport path 32, and then, are temporarily stopped by the register roller 38. After proper timing is controlled, a developer image is transferred to the recording medium while the recording medium is penetrated between the transferring apparatus 42 and the image carrier 44 (will be explained later), and this transferred developer image is fixed on the fixing apparatus 36, and then, the recording medium on which the fixed image has been formed is ejected from the ejection port 34 to the ejection unit 16 by the ejection roller It should be noted that when a double-surface printing mode is carried out, this recording medium is returned to an inversion path 48. In other words, a front path portion of the transport path 30 as to the ejection roller 40 is separated into two paths, a switching craw 46 is provided at this separated path portion, and the inversion path 48 is formed from this separated path portion up to the register roller 38. While transport rollers 50*a* to 50*c* are provided in this inversion path 48, in the case of the double-surface printing mode, the switching claw 46 is switched to such a side that the inversion path 48 is opened. Then, the ejection roller 40 is inverted at a time instant when a front edge portion of a recording medium is engaged with the ejection roller 40, so that this recording medium is conducted to the inversion path 48, and then, is penetrated through the register roller 38, the transfer apparatus 42, the image carrier 44, and the fixing apparatus 36 so as to be ejected from the ejection port 34 to the ejection unit 16.

The ejection unit 16 owns an inclination unit 52 which is freely pivotable with respect to the image forming apparatus main body 12. This inclination unit 52 is inclined in such a manner that an ejection port portion thereof is low and is gradually heightened toward a front surface direction (namely, right direction viewed in FIG. 1). This ejection port portion is used as a lower end of the inclination unit 52 and a tip portion which is heightened is used as an upper end thereof. This inclination unit 52 is supported with respect to the image forming apparatus main body 12 in such a manner that this inclination unit 52 is freely pivotable, while the lower end thereof is located at a center. As indicated by a two-dot/dash line in FIG. 1, when this inclination unit 52 is rotated toward the upper direction so as to be opened, an opening unit 54 is formed, and a process cartridge (will be explained later) 64 can be detachably mounted via this opening unit 54.

The image forming section 14 is made of, for instance, an electro-photographic type image forming unit. This image forming section 14 is arranged by the image carrier 44 constructed of a photosensitive material, a charging apparatus 56, an optical writing apparatus 58, a developing appliance 60, a transferring apparatus 42, a cleaning apparatus 62, and a fixing apparatus 36. The charging apparatus 56 is constituted by, for example, a charge roller capable of uniformly charging the image carrier 44. The optical writing apparatus 58 writes a latent image in an optical manner on the image carrier 44 charged by the charging apparatus 56. The developing appliance 60 develops the latent image of the image carrier 44, which has been formed by the optical writing apparatus 58, by way of developer so as to produce a visible image. The transferring apparatus 42 is constituted by, for example, a transfer roller which transfers the developer image by the developing appliance 60 to paper. The cleaning apparatus 62 is constituted by, for instance, a blade which cleans the developer left on the image carrier 44. The fixing apparatus 36 is arranged by both a pressure-applying roller and a heating roller, by which the developer image which has been transferred onto the paper by the transferring apparatus 42 is fixed on this paper. The optical writing apparatus 58 is constructed of, for example, a scanning type laser exposing apparatus, and is arranged in parallel to the above-described paper supply units 18*a* to 18*d*, and is located in the vicinity of a front surface of the image forming apparatus main body 12. As will be explained later, the optical writing apparatus 58 exposes the image carrier 44 by scanning light beams across the inner space of the developing appliance 60. This exposing position of the image carrier 44 may constitute a latent image writing position "P". It should be noted that in this embodiment mode, the scanning type laser exposing apparatus has been employed as the optical writing apparatus 58. Alternatively, an LED (Light Emitting Diode), a surface emitting laser, and the like may be employed.

The process cartridge 64 is arranged by employing the image carrier 44, the charging apparatus 54, the developing appliance 60, and the cleaning apparatus 62 in an integral body. This process cartridge 64 is arranged just under the inclination unit 52 of the ejection unit 16, and as previously explained, is detachably mounted via the open portion 54 which is formed when the inclination unit 52 is opened.

This process cartridge 64 is detachably separated into an image carrier unit 66 and a developing appliance unit 68. In the image carrier unit 66, the image carrier 44, the charging apparatus 54, and the cleaning apparatus 60 are arranged. In the developing appliance unit 68, the developing appliance 60 is arranged. The developing appliance unit 68 owns a developer storage space 70 which stores there into, for example, developer. An upper portion of this developer storage unit 70 belongs to such an area "A" which is surrounded by the inclination unit 52, a horizontal plane extended from the lower end of the inclination unit 52, and also, a vertical plane extended from the upper end of this inclination unit 52 as indicated by a two-dot/dash line in FIG. 1. Also, an upper wall plane 72 which constitutes the developer storage space 70 is formed in such a manner that this upper wall plane 72 is located in parallel to the inclination unit 52 and along this inclination unit 52. Also, a plurality of ribs 74 are formed on a lower surface of the inclination unit 52 in such a way that these plural ribs 74 are positioned in parallel to each other along the inclination direction of the inclination unit 52. Since these ribs 74 are formed, a flow path 76 is formed between the inclination unit 52 and the process cartridge 64. This flow path 76 is employed so as to penetrate air therethrough, and this flow path 76 may disperse heat produced from the fixing apparatus 36. Furthermore, a grip unit 78 is formed on the upper portion of the developer storage space 70. This grip unit 78 is formed in such a manner that wall surfaces of both sides of the upper portion of the developer storage space 70 are entered into the inside thereof. When the process cartridge 64 is detachably mounted, this process cartridge 64 can be readily detachably mounted by gripping this grip unit 78.

In FIG. 2 to FIG. 8, a detailed construction of the above-described process cartridge 64 is indicated. As explained above, the process cartridge 64 is arranged by the image carrier unit 66 and the developing appliance unit 68, and this image carrier unit 66 is coupled to the developing apparatus unit 68 via coupling pins 80*a* and 80*b* in such a manner that this image carrier unit 66 is freely pivotable with respect to the developing apparatus unit 68. Also, both the image carrier unit 66 and the developing apparatus 68 are energized with each other by a tension spring 82 and a depression spring 84, and a developing roller 86 is depressed against the image carrier 44.

It should also be understood that a memory 88 for storing thereinto a total print number and the like is provided on a side surface of the process cartridge 64 (namely, side surface of one, or both image carrier unit 66 and developing appliance unit 68).

The image carrier unit 66 owns a main body 90 of the image carrier unit 66, and both the image carrier 44 and the charging apparatus 56 are supported by this image carrier unit main body 90 in such a manner that both the image carrier 44 and the charging apparatus 56 are rotatably supported by this image carrier unit main body 90 via bearing 92*a* and 93*b* used for the image carrier 44, and bearings 94*a* and 94*b* used for the charging apparatus 56, respectively. An one of the above-described bearing 94*a* and bearing 94*b* for the charging apparatus 56 own another function of a power supply portion. Also, for example, two fingers 96*a* and 96*b* are supported by the image carrier unit main body 90 in such a manner that these fingers 96*a* and 96*b* are freely pivotable with respect to this image carrier unit main body 90. Since tip portions of these fingers 96*a* and 96*b* are depressed by a spring for the fingers 96*a* and 96*b* on the surface of the image carrier 44, a recording medium which will wrap the image carrier 44 is stripped by these tip portions. Also, a developer collecting space 98 is formed above the cleaning apparatus (cleaning blade) 62 within the image carrier unit main body 90, and thus, developer which has been scratched/dropped by the cleaning apparatus 62 is collected into this developer collecting space 98. A paddle 100 is rotatably provided in this developer collecting space 98. This paddle 100 is supported via a gear 102 for the paddle 100 by the image carrier unit main body 98, and transports the developer which has been collected by being rotated to an inner side of the developer collecting space 98. Also, a shutter 104 is provided at the upper portion of the image carrier unit main body 90 in such a manner that this shutter 104 can be freely opened/closed. This shutter 104 is supported via a shaft 106 for the shutter 104 with respect to the image carrier unit main body 90 in a freely movable manner. This shutter 104 closes an opening portion of the image carrier 44 before the process cartridge 64 is mounted, and is opened in order that the image carrier 44 is come out to the front in the case that the process cartridge 64 is mounted.

The developing appliance unit 68 contains a main body 112 of the developing appliance unit 68 which is constituted by jointing a front housing 108 to a rear housing 110. An inner space of this developing appliance unit main body 112 is segmented into the above-described developer collecting space 70 and a developing unit 114 in which the developing roller 86 is arranged. The developer collecting space 70 is separated into a first developer storage portion 116*a* and a second developer storage portion 116*b* via a partition wall 118, while a horizontal line extended from the latent image writing position "P" is defined as a boundary. This horizontal line corresponds to a scanning optical path originated from the optical writing apparatus 58. The first developer collecting portion 116*a* is located at an upper portion of the developer collecting space 70, whereas the second developer storage portion 116*b* is located at a lower portion thereof. A developer storage capacity of the first developer storage unit 116*a* is made larger than a developer storage capacity of the second developer storage unit 116*b*.

Figure 3:
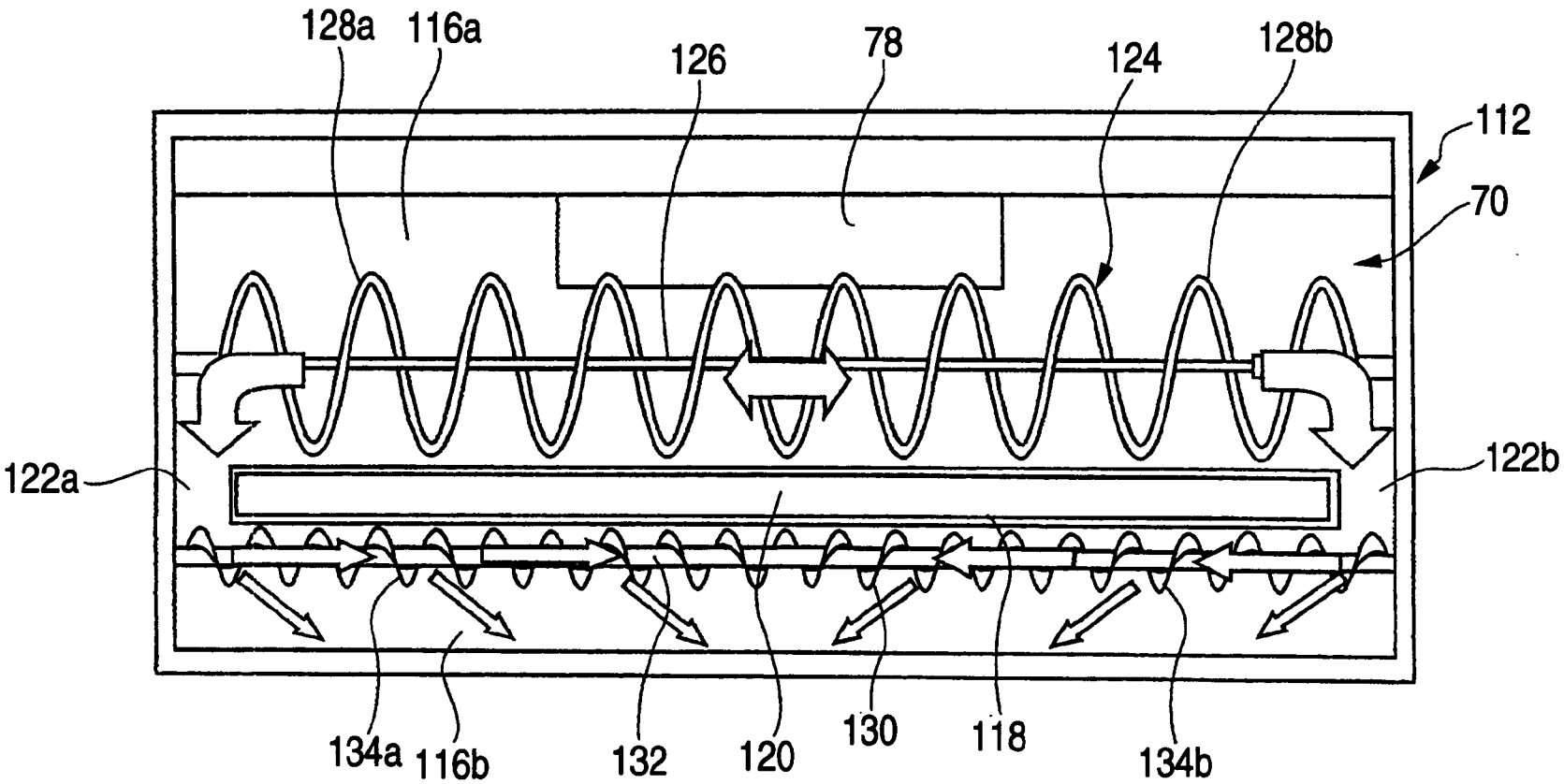
FIG. 3 is a side view for showing a supply path of developer in the process cartridge according to the embodiment mode of the present invention.
Figure 4:
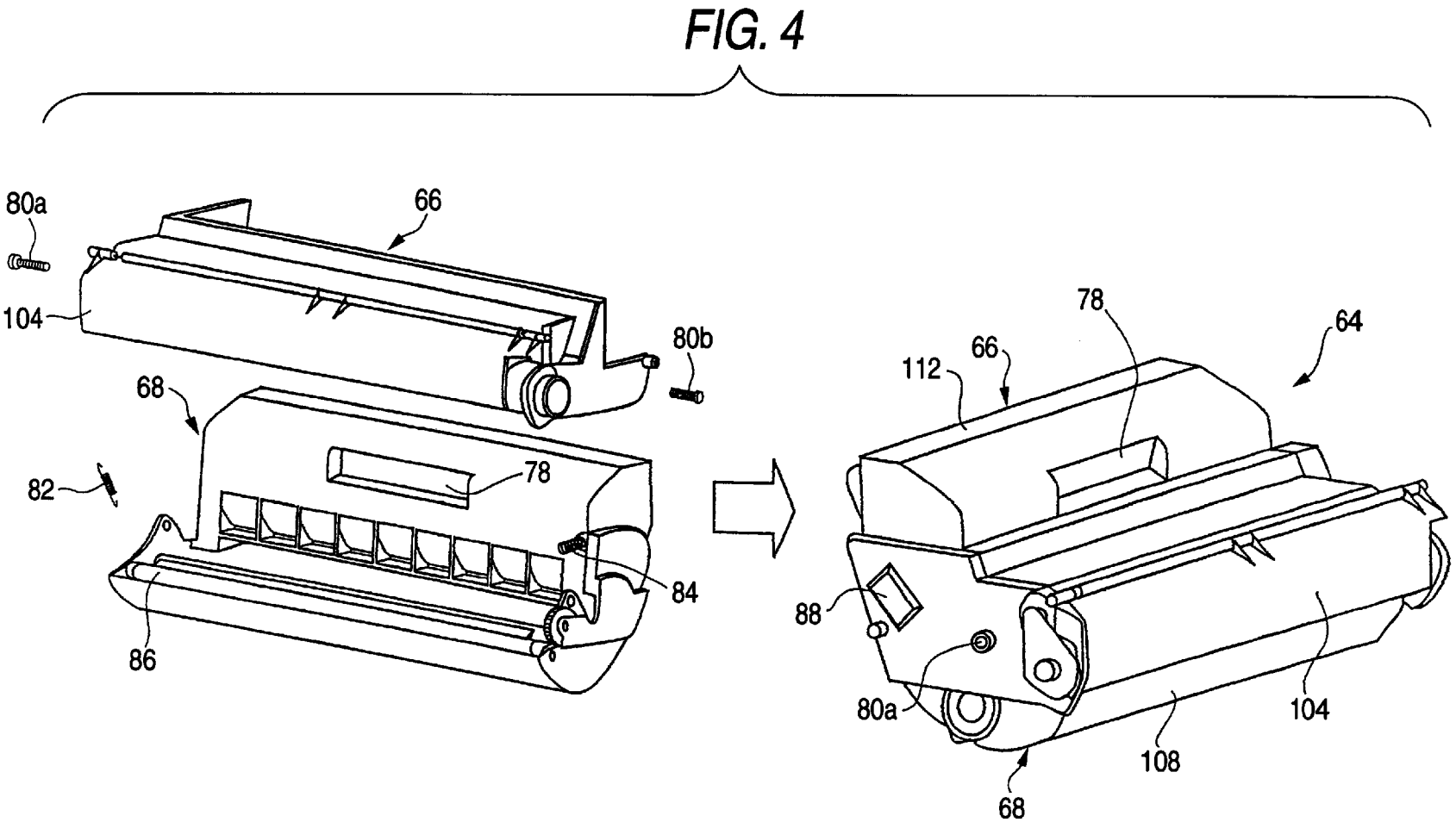
FIG. 4 is a perspective view for indicating the process cartridge according to the embodiment mode of the present invention.
Figure 5:
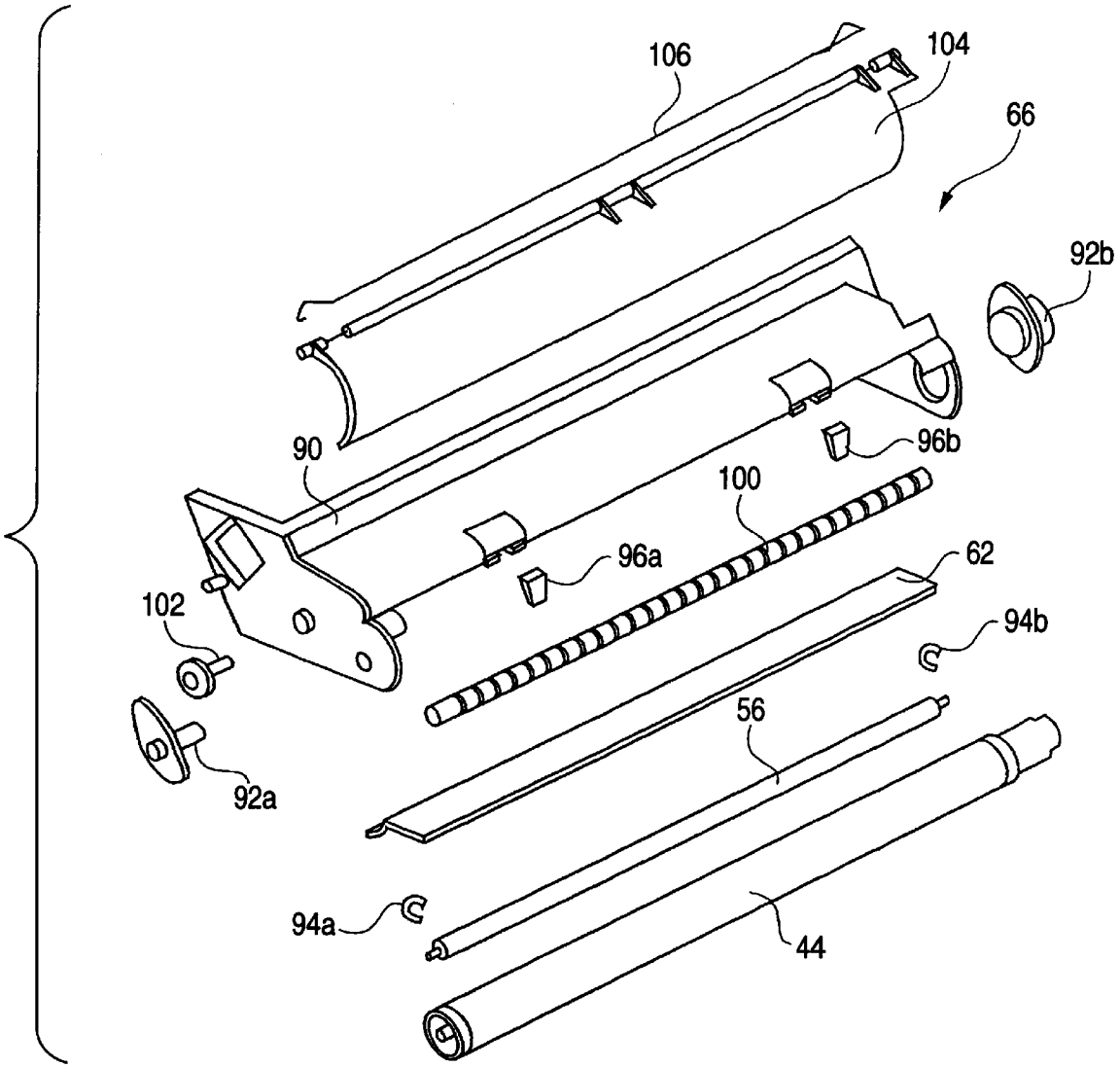
FIG. 5 is an exploded perspective view for indicating an image carrier unit of the process cartridge according to the embodiment mode of the present invention.

As shown in FIG. 3, the partition wall 118 constitutes a window portion 120 having, for example, a rectangular shape, which forms the optical scanning path defined from the optical writing apparatus 58. Also, this partition wall 118 constitutes developer paths 122*a* and 122*b* in connection with the developing appliance unit main body 112 on both sides of this window portion 120. Both the developer paths 122*a* and 122*b* cause the first developer storage portion 116*a* to be communicated with the second developer storage portion 116*b*. In the first developer storage portion 116*a*, as previously explained, a first stirring/transporting member 124 is rotatably arranged, and also an upper portion of this first developer storage portion 116*b* is arranged within the area "A."

Figure 6:
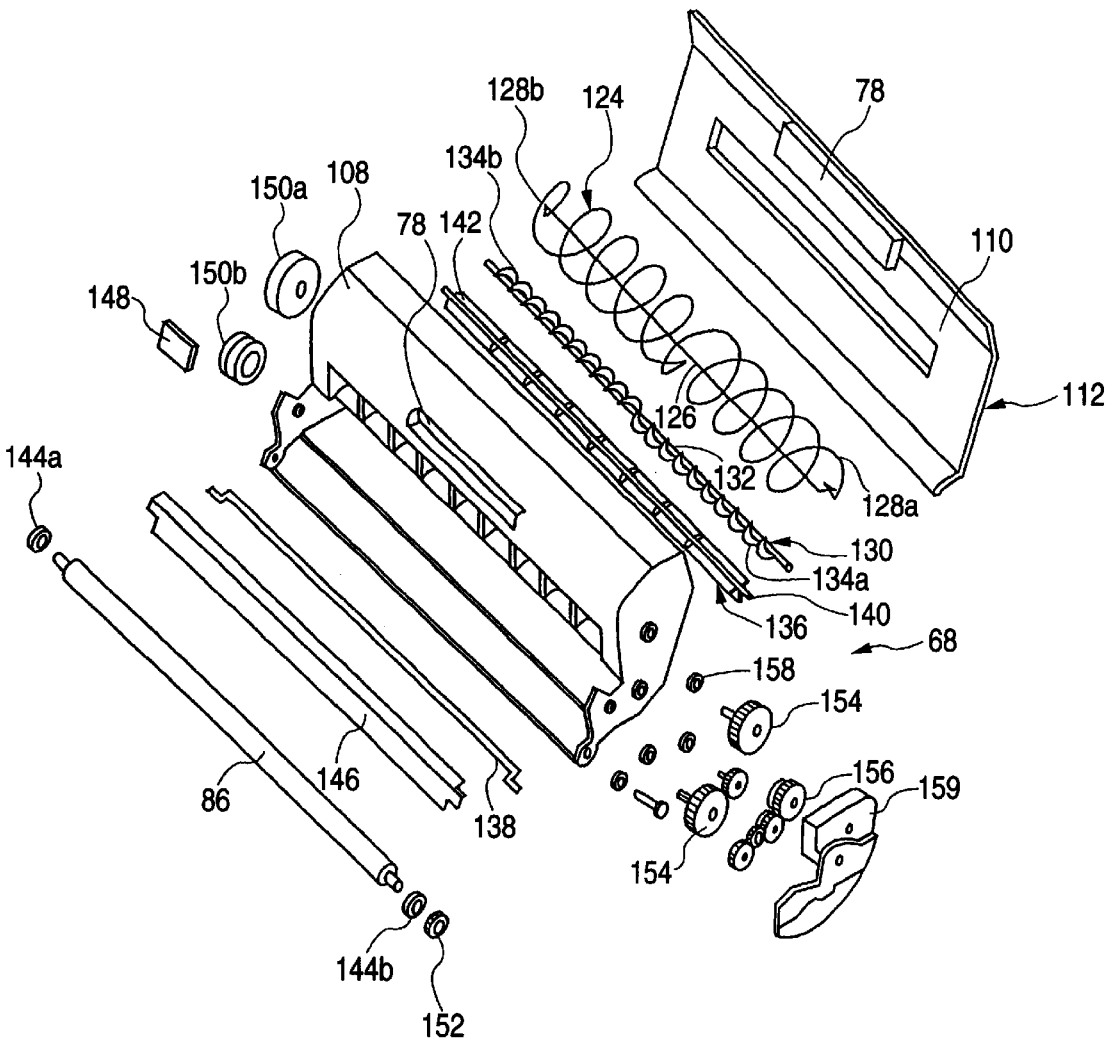
FIG. 6 is an exploded perspective view for representing a developing appliance unit of the process cartridge according to the embodiment mode of the present invention.
Figure 7:
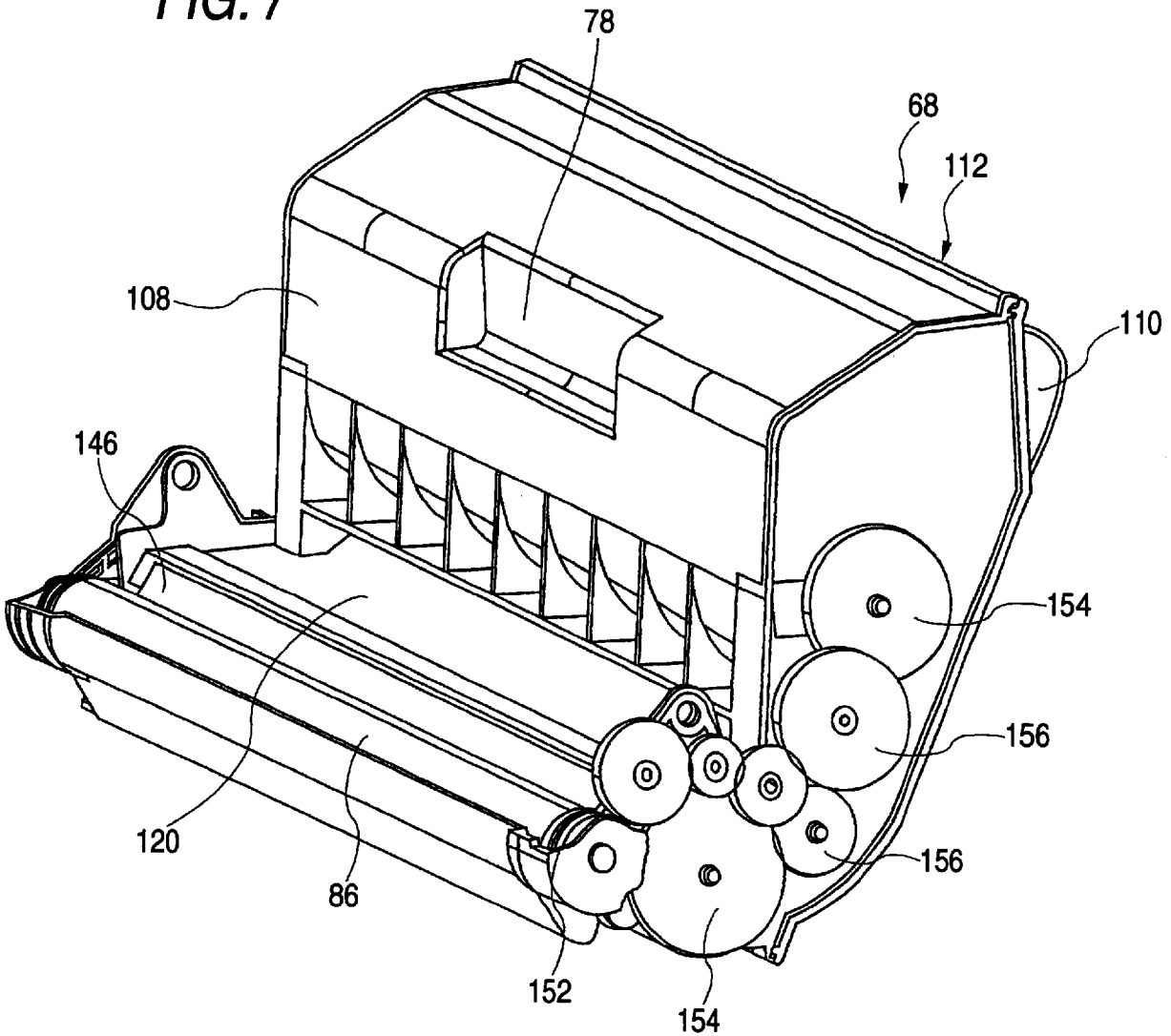
FIG. 7 is a perspective view for showing the developing appliance unit of the process cartridge according to the embodiment mode of the present invention.
Figure 8:
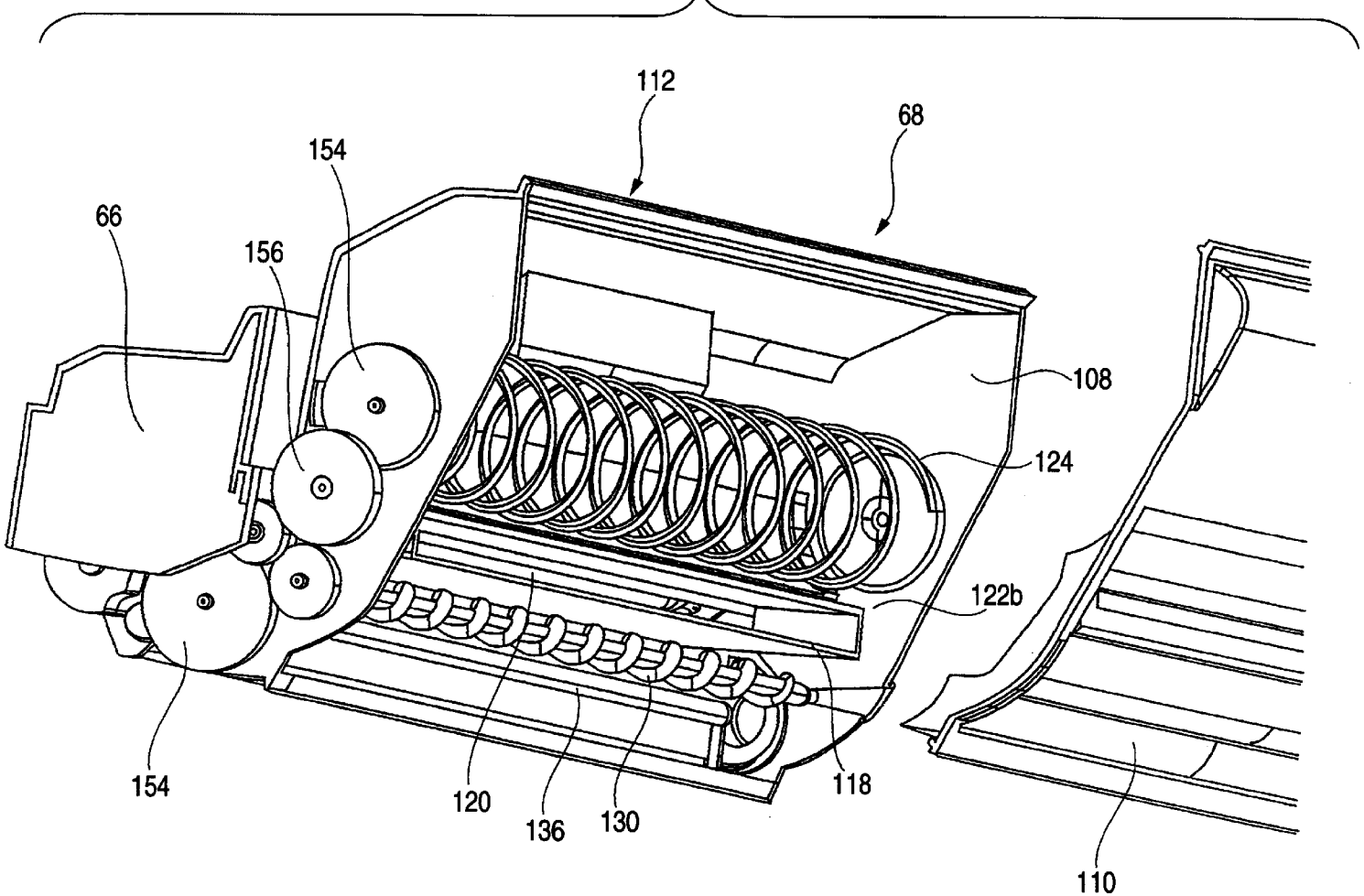
FIG. 8 is an exploded perspective view of the developing appliance unit of the process cartridge according to the embodiment mode of the present invention, as viewed from a rear surface of the developing appliance unit.

As indicated in FIG. 3 and FIG. 6, the first stirring/transporting member 124 contains a shaft portion 126, and winding portions 128*a* and 128*b* which are formed in helical shapes along different winding directions which are directed from a center portion (viewed along axial line direction) of this shaft portion 126 to both edge portions thereof. This shaft portion 126 and the winding portions 128*a*, 128*b* are constituted by a single wire material. As a consequence, when this first stirring/transporting member 124 is rotated, the developer stored in the first developer storage portion 116*a* can be supplied to the developer paths 122*a* and 122*b* provided on both sides along the axial line direction, and thus, the developer maybe supplied via these developer paths 122*a* and 122*b* to the second developer storage portion 116*b*.

A second stirring/transporting member 130 is rotatably arranged at a lower position of the first stirring/transporting member 124 within the second developer storage unit 116*b*. As shown in FIG. 3 and FIG. 6, this second stirring/transporting member 130 is constituted as a screw shaft which is constituted by a shaft portion 132, and also screw portions 134*a* and 134*b*. These screw portions 134*a* and 134*b* are formed from edge portions (viewed along axial direction) of this shaft portion 132 to a center portion thereof along different directions. As a consequence, when this second stirring/transporting member 130 is rotated, larger amounts of the developer are transported from the both-sided developer paths 122*a* and 122*b* toward the center direction, and then the developer is uniformly dispersed to be supplied to a subsequent third stirring/transporting member 136.

Furthermore, both a third stirring/transporting member 136 and a fourth stirring/transporting member 138 are arranged in the second developer storage portion 116*b*. The third stirring/transporting member 136 transports the developer to the fourth stirring/transporting member 138, while this third stirring/transporting member 136 owns a shaft portion 140, and a plate-shaped portion 142, one edge of which is fixed on this shaft portion 140, and also which is extended along a circumferential direction. The fourth stirring/transporting member 138 transports the developer which has been transported by the third stirring/transporting member 142 to the developing roller 86, and also, mixes this new developer with the developer which has been scratched/dropped from the developing roller 86.

As is well known in the field, the developing roller 86 is constructed in such a manner that a sleeve is wound on a magnet roller, and tracking caps 144*a* and 144*b* are provided on both sides of the magnet roller. These tracking caps 144*a* and 144*b* are made in contact to the image carrier 44, and as explained in the above description, a developing gap may be secured by depressing these tracking caps 144*a* and 144*b* against the image carrier 44 by both the tension spring 82 and the depression spring 84. A layer thickness restricting member 146 made of, for instance, a resin is made in contact with the developing roller 86. A thickness of a developer layer adhered on the surface of the developing roller 86 is restricted by this layer thickness restricting member 146. Also, a side surface of this developing roller 86 is sealed by a developing portion sealing member 148.

It should also be noted that reference numerals 150*a* and 150*b* indicate developer caps which are detachably mounted on the developing appliance unit main body 112. Since these developer caps 150*a* and 150*b* are pulled out, the developer is supplied to either the first developer storage unit 116*a*, or the second developer storage unit 116*b*.

In the drive system of the process cartridge 64, drive force is transferred from the side of the image carrier 44, and then, is transferred via a developing roller gear 152, a gear 154 for the respective first to fourth stirring/transporting members, and an idle gear 156 to the developing roller 86 and also to the respective first to fourth stirring/transporting members 124, 130, 136, and 138. A stirring/transporting member sealing member 158 is inserted into a bearing portion of the stirring/transporting member gear 154. Furthermore, a gear cover 159 is provided on the side surface of the developing appliance unit main body 112, while this gear cover 159 covers the gear 154 for the respective stirring/transporting members and the idle gear 156.

Next, operations of the image forming apparatus according to the above-described embodiment mode will now be described.

While the image carrier 44 is uniformly charged by the charging apparatus 56, light emitted from the optical writing apparatus 58 is irradiated onto this charged image carrier 44 in response to an image signal, and then, a latent image is formed at the latent image forming position "P" thereof. The light emitted from the optical writing apparatus 58 passes through the process cartridge 64 via the window portion 120 of the process cartridge 64. The latent image which has been formed on the image carrier 44 by this optical writing apparatus 58 is developed by the developer of the developing appliance 60 so as to produce a visible image.

While the developer has been stored in both the first developer storage portion 116*a* and the second developer storage portion 116*b*, the developer stored in the first developer storage portion 116*a* is transported to both sides by rotating the first stirring/transporting member 124, and then both the developer located on the both sides is transported via the two developer paths 122*a* and 122*b* to the second developer storage unit 116*b*. Furthermore, the developer of the second developer storage portion 116*b* is uniformly dispersed by rotating the second stirring/transporting member 130, and then, the uniformly dispersed developer is transported to the developing unit 114 by the third stirring/transporting member 136 and the fourth stirring/transporting member 138. In this developing unit 114, the transported developer is adhered onto the developing roller 86, the layer thickness of the adhered developer is restricted by the layer thickness restricting member 146, the thickness restricted developer is transported up to a developing position located opposite to the image carrier 44, and then, an image made of the developer is formed in correspondence with the latent image of the image carrier 44.

On the other hand, one of the paper supply units 18*a* to 18*d* is selected in response to a size signal and the like, recording mediums stored in one of these paper supply cassettes 22 are fed out by the nudger roller 24, and these recording mediums are smoothly separated by the retard roller 26 and the feed roller 28 so as to conduct a recording medium to the transport path 32. Then, this conducted recording medium is temporarily stopped by the register roller 38, and thereafter, this recording medium is conducted between the transferring apparatus 42 and the image carrier 44 at proper timing.

When the recording medium is conducted between the transferring apparatus 42 and the image carrier 44 in this manner, the developer on the image carrier 44 is transferred to the recording medium by the transferring apparatus 42. This recording medium to which the developer has been transferred is penetrated through the fixing apparatus 36, and then is ejected from the ejection port 34 to the ejection unit 16.

The recording medium is penetrated through the transport path 32, and then is ejected to the ejection unit 16, and thus a so-called "C-path" is constituted, while this transport path 32 is formed along the substantially vertical direction from the paper supply units 18*a* to 18*d* arranged along the horizontal direction. In this embodiment mode, since the process cartridge 64 is stored within the C-path, the layout of this image forming apparatus can be made compact. However, if the developer storage space connected to the developing unit 114 is arranged lower than the latent image writing position "P" in the normal design manner, such a dead space is produced under the ejection portion 16. More specifically, in the case that a storage capacity of the developer is increased, since the space located lower than the latent image writing position "P" must be increased, a larger dead space is produced.

However, in this embodiment mode, the window portion 120 which constitutes the scanning optical path from the optical writing apparatus 58 is formed in the process cartridge 64, and also, the developer paths 122*a* and 123*b* are formed on both sides of this window portion 120, so that the first developer storage portion 116*a* can be arranged above the scanning optical path. As a result, the image forming apparatus can be made compact, while the sufficiently large developer storage capacity can be maintained.

Figure 9A:
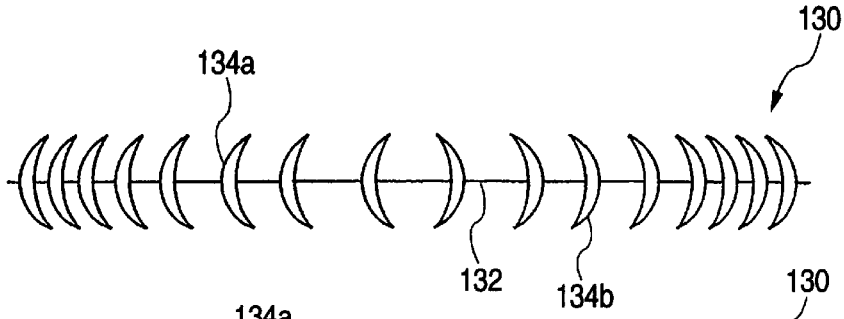
FIGS. 9A to 9E are side views for indicating modifications of second stirring/transporting members employed in the process cartridge according to the embodiment mode of the present invention.

In FIGS. 9A to 9E, various sorts of modifications are illustrated with respect to the above-described second stirring/transporting member 130. Similar to the above-described embodiment mode, a second stirring/transporting member 130 shown in FIG. 9A is similarly constituted by employing a shaft portion 132, and two screw portions 134*a* and 134*b* which are formed from edge portions of this shaft portion 132 (as viewed in axial line direction thereof) toward a center portion thereof along mutually different directions. However, this second stirring/transporting member 130 owns such a different structural point that a pitch of each screw part of the screw portions 134*a* and 134*b* is continuously changed. The pitches of the screw portions 134*a* and 134*b* are gradually increased from the both edge portions thereof to the center portions thereof in order that the developer may be easily collected to the center parts thereof, and thus, the transport amounts of the developer along the axial direction can be made equal to each other.

Figure 9B:
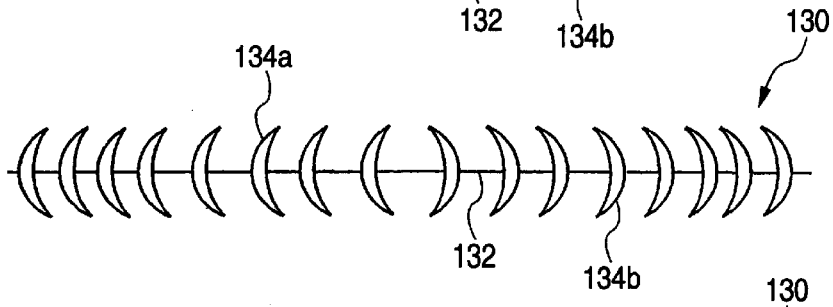
Figure 9C:
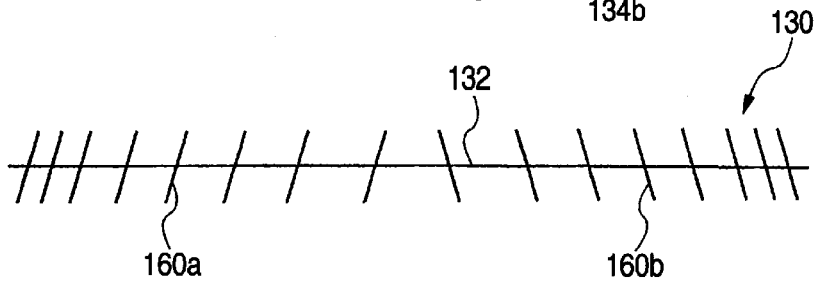
Figure 9D:
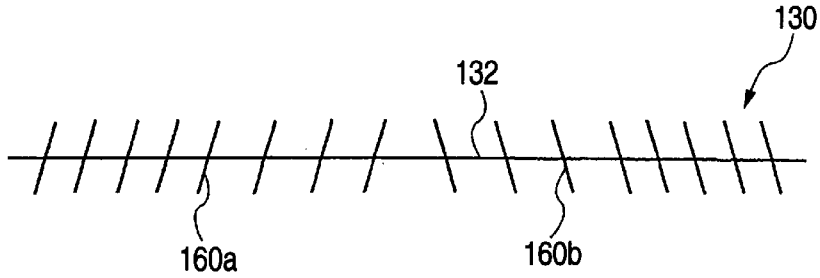

As to a second stirring/transporting member 130 indicated in FIG. 9B, pitches of respective screw portions are changed in a stepwise manner in contrast to the above-explained second stirring/transporting member 130 of FIG. 9A in which the pitches of the respective screw portions are changed in the continuous manner. As to a third stirring/transporting member 130 shown in FIG. 9C, while flat plate portions 160*a* and 160*b* are employed instead of the screw portions, pitches of these flat plate portions 160*a* and 160*b* are changed in a continuous manner. As to a second stirring/transporting member 130 represented in FIG. 9D, the pitches of the flat plate portions 160*a* and 160*b* are changed in a stepwise manner.

Figure 9E:
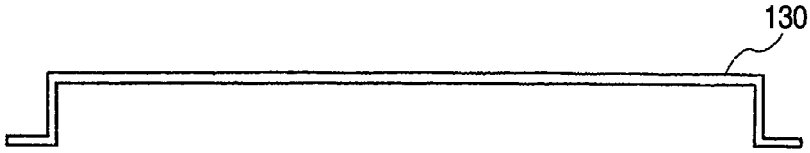

A second stirring/transporting member 130 indicated in FIG. 9E is constituted by a wire line material formed in a crank shape. In the case that developer owns good fluidity, the developer may be uniformly transported due to the good fluidity of this developer by merely forming the wire line material in the crank shape and by merely stirring the developer.

It should be noted that the second stirring/transporting members 130 with employment of the above-described constructions may be driven in an intermittent manner so as to control the transport amount thereof. In order to intermittently drive these second stirring/transporting members 130, for instance, a pulse motor may be employed irrespective of motors which are employed in other drive systems.

In the above-described embodiment modes, the one-component developing system is employed. The present invention is not limited to this one-component developing system, but may be applied to a two-component developing system. Also, in the above-explained embodiment mode, the developer image is directly transferred from the image carrier to the recording medium. However, the present invention is not limited to this transfer operation, but may be applied to another embodiment in which an intermediate transfer member may be interposed between the image carrier and the recording medium. Furthermore, in the above-described embodiment modes, the black/white image forming apparatus has been described. Apparently, the present invention may be applied to a color image forming apparatus.

As previously explained, in accordance with the present invention, since the developer storage portions are provided along the upper/lower portions by sandwiching therebetween the latent image writing position of the image carrier, the image forming apparatus can be made compact while the sufficiently large developer storage capacity can be maintained.

What is claimed is:

1. A process cartridge detachably mounted on a main body of an image forming apparatus comprising:

an image carrier; and a developing apparatus having a developer storage space, for developing a latent image formed on the image carrier to produce a visible image; wherein:

the developer storage space is segmented into a first developer storage portion and a second developer storage portion along upper/lower directions, while sandwiching therebetween a latent image writing position of the image carrier into which the latent image is written; and also the first developer storage portion is communicated to the second developer storage portion via a developer path.

2. A process cartridge according to claim 1, wherein the developer path is formed at a peripheral portion of a window portion which constitutes an optical scanning path.

3. A process cartridge according to claim 2, wherein the developer path is formed on both sides of the window portion.

4. A process cartridge according to claim 3, wherein the first developer storage portion owns a first stirring/transporting member which stirs/transports the developer from a center of the first stirring/transporting member to both sides thereof.

5. A process cartridge according to claim 4, wherein the second developer storage portion owns a second stirring/transporting member which stirs/transports the developer from both sides of the second stirring/transporting member to a center thereof.

6. A process cartridge according to claim 5, wherein the second stirring/transporting member is driven in an intermittent manner.

7. An image forming apparatus, wherein the image forming apparatus is comprised of the process cartridge recited in claim 1.

* * * * *